US005752776A

United States Patent [19]

Kunreuther

[11] Patent Number: 5,752,776

[45] Date of Patent: May 19, 1998

[54] COMPUTER IMPLEMENTED METHOD FOR SIMULTANEOUSLY CONTROLLING TANDEM LABEL PRINTERS

[76] Inventor: Steven Kunreuther, 285 Central Park West, New York, N.Y. 10024

[21] Appl. No.: 702,944

[22] Filed: Aug. 26, 1996

[51] Int. Cl.[6] ..... B41J 3/54

[52] U.S. Cl. ..... 400/82; 400/68; 400/188

[58] Field of Search ..... 400/68, 71, 82, 400/188

[56] References Cited

U.S. PATENT DOCUMENTS

| | | | |
|---|---|---|---|
| 2,867,167 | 1/1959 | Mitchell | 400/82 |
| 3,889,592 | 6/1975 | Lupkas et al. | 101/93.04 |
| 4,576,492 | 3/1986 | Sugawara et al. | 400/146 |
| 4,692,041 | 9/1987 | Dyma et al. | 400/82 |
| 4,951,564 | 8/1990 | Wilson et al. | 400/82 |
| 5,452,959 | 9/1995 | Oka | 400/188 |
| 5,456,539 | 10/1995 | Wright et al. | 400/568 |
| 5,486,057 | 1/1996 | Skinner et al. | 400/188 |

OTHER PUBLICATIONS

Markem TA755/56 Brochure.
Fasco 640–Brochure.

*Primary Examiner*—Edgar S. Burr
*Assistant Examiner*—Steven S. Kelley
*Attorney, Agent, or Firm*—James & Franklin; Robert L. Epstein; Harold James

[57] ABSTRACT

First and second oppositely oriented, spaced apart tandem printers are simultaneously computer controlled to print both sides of labels on a continuous web of blank labels. The front and back designs, the number of labels to be printed and the number of labels on the web between the printers are each entered into the computer and stored. The first printer is actuated to print label fronts and the web is advanced. The second printer is not actuated to print label backs until the first printer has printed the fronts of a number of labels equal to the number of labels between the printers. After the first printer has completed printing the fronts of the required number of labels, the second printer will continue printing an additional number of label backs equal to the number of labels between the printers. Sets of different labels can be printed sequentially. After the first printer has completed the fronts of each of the labels in one set and begins printing the fronts of the labels of the next set, the second printer will continue to print the backs of the labels in the first set until same are completed, before changing to print the backs of the labels in the second set. In this way, no stock is wasted between label sets, set up time and run time is reduced and printing of sets of small numbers of different labels can be done economically.

28 Claims, 6 Drawing Sheets

COMPUTER IMPLEMENTED METHOD FOR SIMULTANEOUSLY CONTROLLING TANDEM LABEL PRINTERS

The present invention relates to computer controlled label printers and more particularly to a method for simultaneously controlling first and second oppositely oriented, spaced apart tandem computer controlled label printers to sequentially print both sides of sets of different labels on a continuous web of blank labels.

Garment manufacturers and other businesses require labels to be affixed to their products. Commercially available computer controlled printers are commonly used to print the labels. The labels contain printed material, in the form of text, symbols, graphics or the like, on the front and on the back. Normally, the labels have different designs on the back and front. For the purposes herein, the term "design" will be used to indicate that which is to appear on one side of a label, including text, symbols, graphics and blank spaces.

For use in the printer, blank labels are provided on a continuous web. The web is pre-perforated so that the individual labels can be easily separated from the web after printing. The blank labels are commonly provided in rows, several labels across, depending upon their size. Each web can have hundreds of rows of blank labels. The web includes removeable carrier strips on each side of the labels. Each carrier strip has a series of sprocket holes for engagement with the sprockets in the computer controlled printer to provide a positive feed of the web through the printer.

Computer controlled label printers capable of printing both sides of labels are available from a number of sources. For example, Model 640 from Fasco Labeling Systems of Sayre, Pa., a division of the Paxar Company, or Models TA755 or TA756 from Markem Corporation of Keena, N.H. are well known and commonly used. These printers are computer controlled and use proprietary software and hardware. However, these printers print on a strip of stock only, one label wide. Hence, only one label is printed at a time. After each label is printed, it is cut from the strip as it passes through the cutting station.

Available from Texpak, Inc. of 130 New Hyde Park Road, Franklin Square, N.Y. 11010 is the CAREFREE ® Computer Printer System designed to print one side of a series of labels forming a continuous web. In this system, information defining the design to be printed on one side of each label and the number of labels to be printed is programmed into a computer, which is connected to the printer. The web is placed in the printer and one side of each of the desired number of labels is printed in sequence. Then the controller is programmed with the design for the other side of the label. The web is turned over and reinserted into the printer. The web is run through the printer a second time, such that the other side of each of the labels is printed.

Although the Texpak CAREFREE ® System is capable of printing on a continuous web, it has several obvious drawbacks. First, it takes twice as much time to print the labels because the fronts and backs have to be printed separately. The controller must be programmed twice, once for the front design and once for the back design.

Second, each time a different side of the label is to be printed, the web must be taken out, reinserted and the printer restarted. This may not be a major problem when a large number of labels with a single design is required. However, many situations require relatively small numbers of different labels be printed. In those instances, having to stop after each side is printed and turn the web increases the amount of time to do each job greatly.

In order to overcome these problems, I have invented a software implemented method for simultaneously controlling a pair of conventional computer controlled label printers to print both sides of a plurality of labels on a continuous web of blank labels, in a single run. Moreover, the controller can be programmed to continuously print both sides of sets of different labels in sequence, without wasting any label stock and with a minimum of set up time.

It is, therefore, a prime object of the present invention to provide a computer implemented method of simultaneously controlling to operation of conventional computer controlled label printers to print both sides of a plurality of labels in a single run.

It is another object of the present invention to provide a computer implemented method of simultaneously controlling the operation of conventional computer controlled label printers to print both sides of a plurality of labels with a minimum of set-up time.

It is another object of the present invention to provide a computer implemented method of simultaneously controlling the operation of conventional computer controlled label printers to print both sides of a plurality of sets of different labels in sequence, in a single run, without wasting label stock.

It is another object of the present invention to provide a computer implemented method of simultaneously controlling the operation of conventional computer controlled label printers to print both sides of a plurality of sets of different labels, in sequence, in a single run, with a minimum of set up time.

Although this invention is primarily directed to label printing, the concept is more generally applicable and can be applied in any situation where both sides of sections of a continuous web are to be printed. Accordingly, the term "sections" is used herein to refer to any area on the web, which may be a sheet, a page, a label, a part of a label, a row of labels or any other item which can be formed from a part of the web, usually by separating the web along pre-perforated lines. When reference is made to the printer advancing to the next section, this means advancing to the next section of the web in the direction of web movement relative to the printers. If rows of labels are being printed, advancing to the next section means advancing to the next row of labels in the direction of the movement of the web relative to the printers.

In accordance with one aspect of the present invention, a computer implemented method is provided for controlling the operation of first and second oppositely oriented, spaced tandem printers to print both sides of sections of a continuous web. First and second designs for the first and second printers, respectively, are stored. Also stored are the number of sections between the printers and the number of sections to be printed.

As the printers print, the number of section sides printed by each printer is continuously tracked. This can be done by one or more counters.

The first printer is actuated to print one section side. Each printer is actuated to advance to the next section. These steps are repeated until the number of section sides printed by the first printer reaches the stored number representing the number of sections between the printers.

Next, each printer is actuated to print one section side. Each printer is actuated to advance to the next section. These steps are repeated until the number of section sides printed by the first printer reaches the stored number representing the number of sections to be printed.

Then, the second printer is actuated to print one section side. Each printer is actuated to advance to the next section.

These steps are repeated until the number of section sides printed by the second printer equals the stored number representing the number of sections to be printed. At this point, both sides of the desired number of labels have been printed and the run terminates.

Each section may comprise a single label or a horizontal row of labels on the web. When printing rows of labels, the step of actuating a printer to print one section side includes actuating the printer to print one side of each label in a row of labels.

The continuous web may include a carrier strip with printed numbers corresponding to the sections. In that case, the stored number can be obtained by subtracting the number of the section aligned with the first printer from the number of the section aligned with the second printer.

The method is provided in software, preferably on a diskette, for use in a computer operably connected to the printers. The information on the diskette can be stored in the computer hard drive.

In accordance with another aspect of the present invention, a computer implemented method is provided for simultaneously controlling the operation of first and second oppositely oriented, spaced tandem printers to print both sides of sets of sections with different designs, in sequence, on a continuous web. First and second designs for the first printer and third and fourth designs for the second printer are stored. Also stored are a first number representing the number of sections between the printers, a second number representing the number of sections in a first set of sections to be printed with the first and third designs and a third number representing the number of sections in a second set of sections to be printed with the second and fourth designs.

As the printing takes place, the number of section sides printed with each design by each printer is tracked. This can be done with two or more counters.

The first printer is actuated to print one section side with the first design. Each printer is actuated to advance to be next section. These steps are repeated until the number of section sides printed with the first design by the first printer reaches the first stored number.

The first printer is actuated to print one section with the first design. The second printer is actuated to print one section with the third design. Each printer is actuated to advance to the next section. These steps are repeated until the number of section sides printed by the first printer design equals the second stored number.

The first printer is actuated to print one section side with the second design. The second printer is actuated to print one section side with the third design. Each printer is actuated to advance to the next section. These steps are repeated until the number of section sides printed by the second printer with the third design reaches the second stored number.

The first printer is actuated to print one section with the second design. The second printer is actuated to print one section with the fourth design. Both printers are actuated to advance to the next section. These steps are repeated until the number of section sides printed by the first printer with the second design reaches the third stored number.

The second printer is actuated to print one section side with the fourth design. Each printer is actuated to advance to the next section. These steps are repeated until the number of section sides printed with the fourth design by the second printer reaches the third stored number. When this occurs, both sides of the desired number of sections in each set have been printed and the run is completed.

In accordance with another aspect of the present invention, a system is provided for printing both sides of sections of a continuous web. The system comprises a first printer and a second printer. The printers are oriented in opposite directions relative to the web. A computer simultaneously controls the operation of each printer. Means are provided for operably connecting the computer to each of the printers.

Means are provided for mounting the first and second printers in opposite orientations along the web.

To these and to such other objects as may hereinafter appear, the present invention relates to a computer implemented method for simultaneously controlling tandem label printers, as set forth in detail in the following specification and recited in the annexed claims, taken together with the accompanying drawings, wherein like numerals refer to like parts and in which:

Figure 4A:
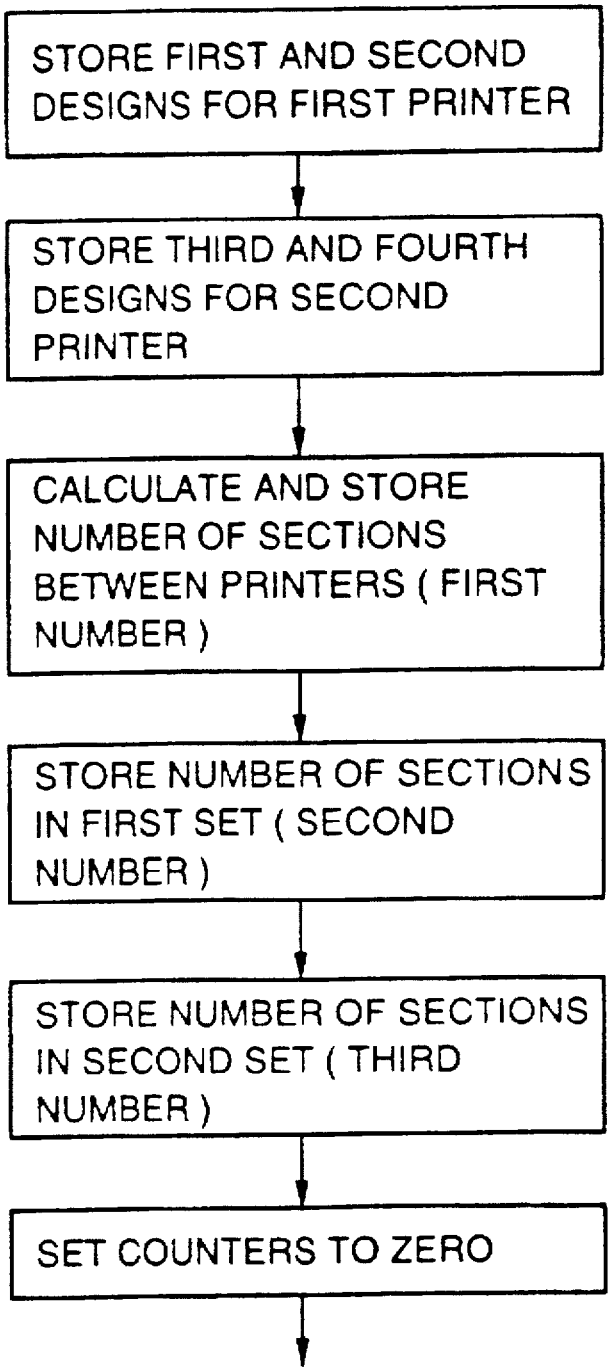
Figure 4B:
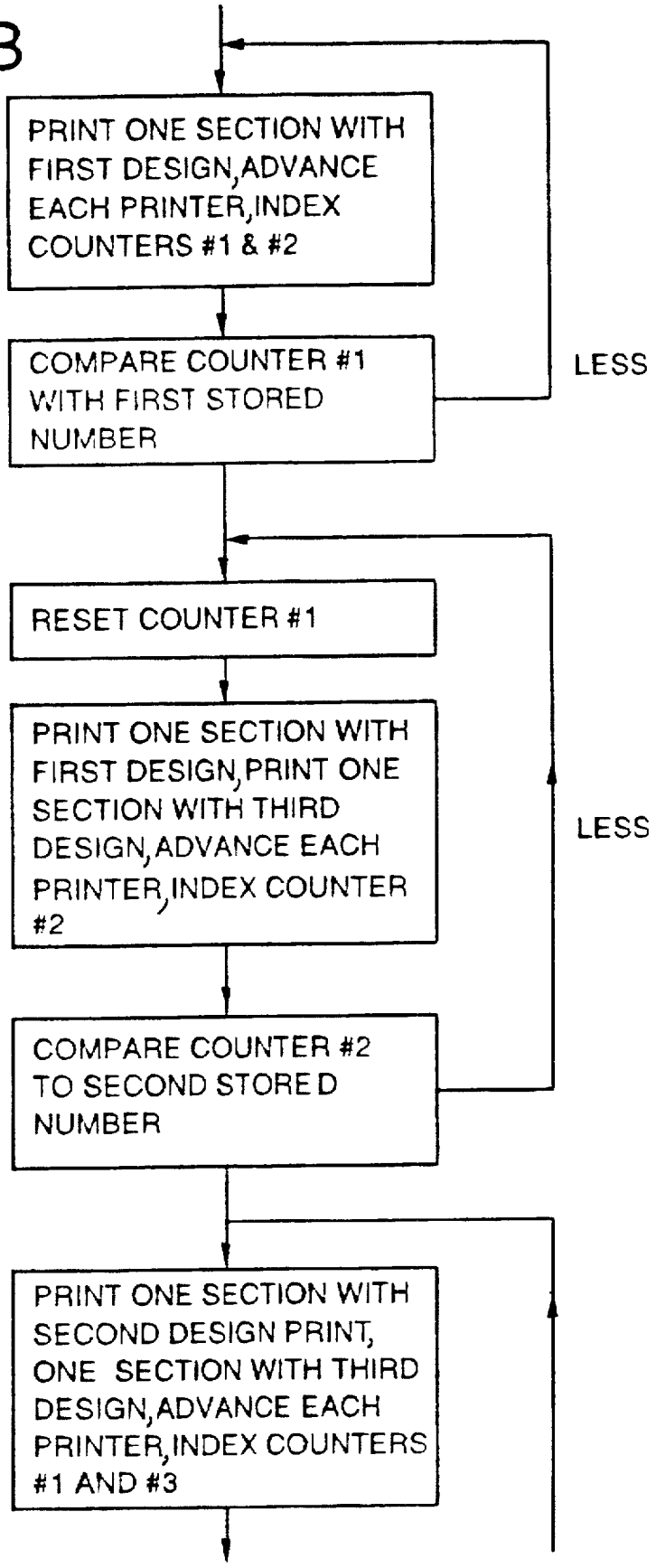
Figure 4C:
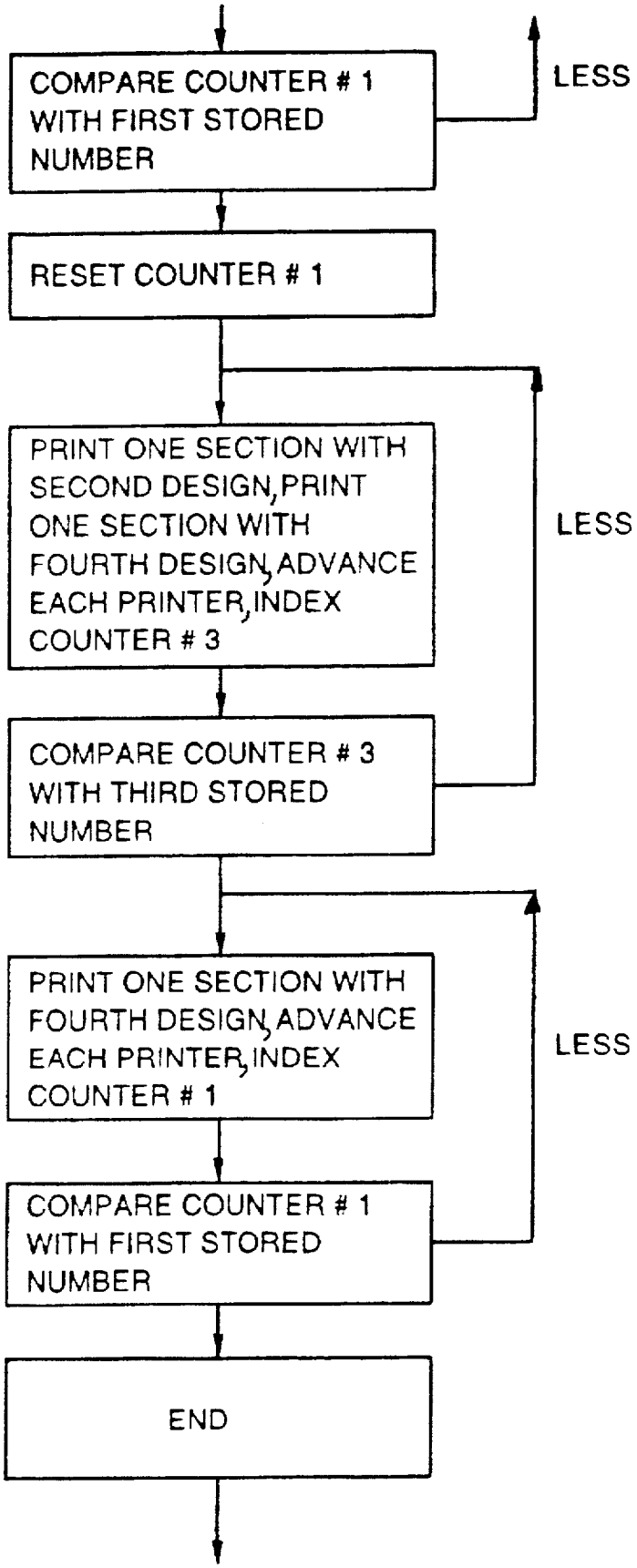
Figure 5:
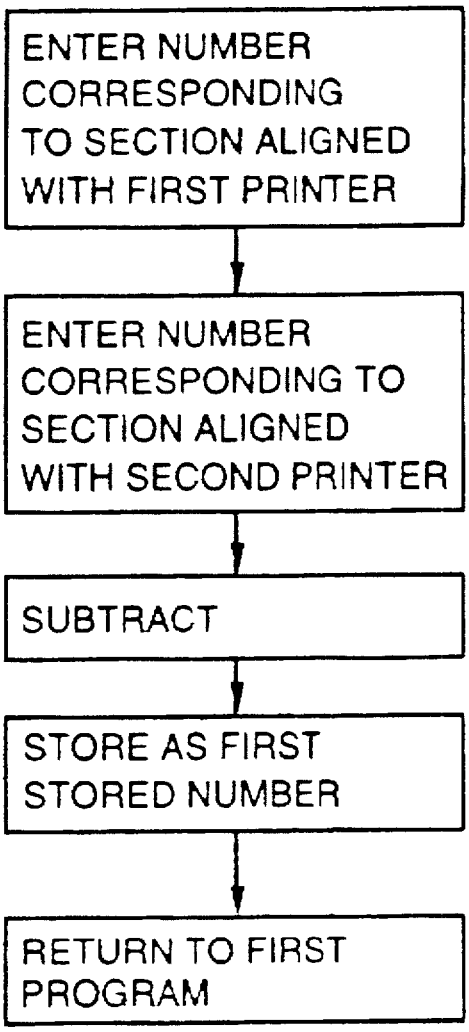

FIGS. 4A, 4B, 4C collectively form a flow chart illustrating the steps in the method of the present invention; and FIG. 5 illustrates a sub-routine for calculating and storing the number representative of the number of sections between the printers.

Figure 1:
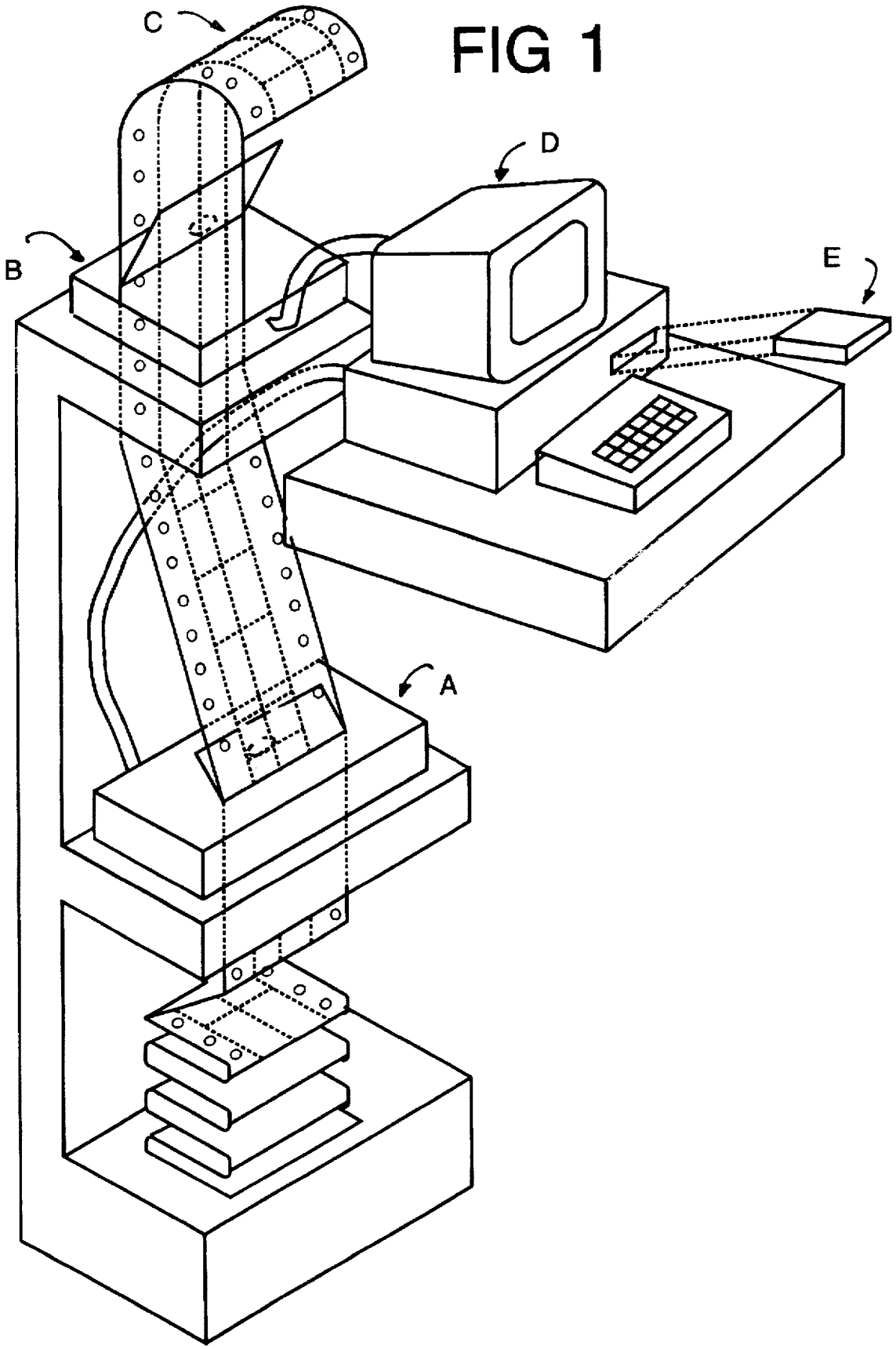
FIG. 1 is an isometric view showing the printers and computer controller connected thereto.

As seen in FIG. 1, first and second conventional computer controlled printers, generally designed A and B, respectively, are oppositely oriented with respect to a continuous web, generally designated C. Thus, printer A will print on one side of web C and printer B will print on the other side of web C. This set up can be conveniently achieved using a three tier rack, as illustrated, where the web supply is located on the bottom tier, printer A is situated on the middle tier and printer B is placed on the top tier.

Connected to both of the printers by a suitable conventional cables is a single controller in the form of a conventional personal computer, generally designed D. Computer D can be an IBM PC, an Apple MacIntosh or any equivalent. Computer D has a slot adapted to accept a diskette, generally designed E, containing software defining the computer implemented method of the present invention. The software may be transferred to the computer hard drive.

Figure 2:
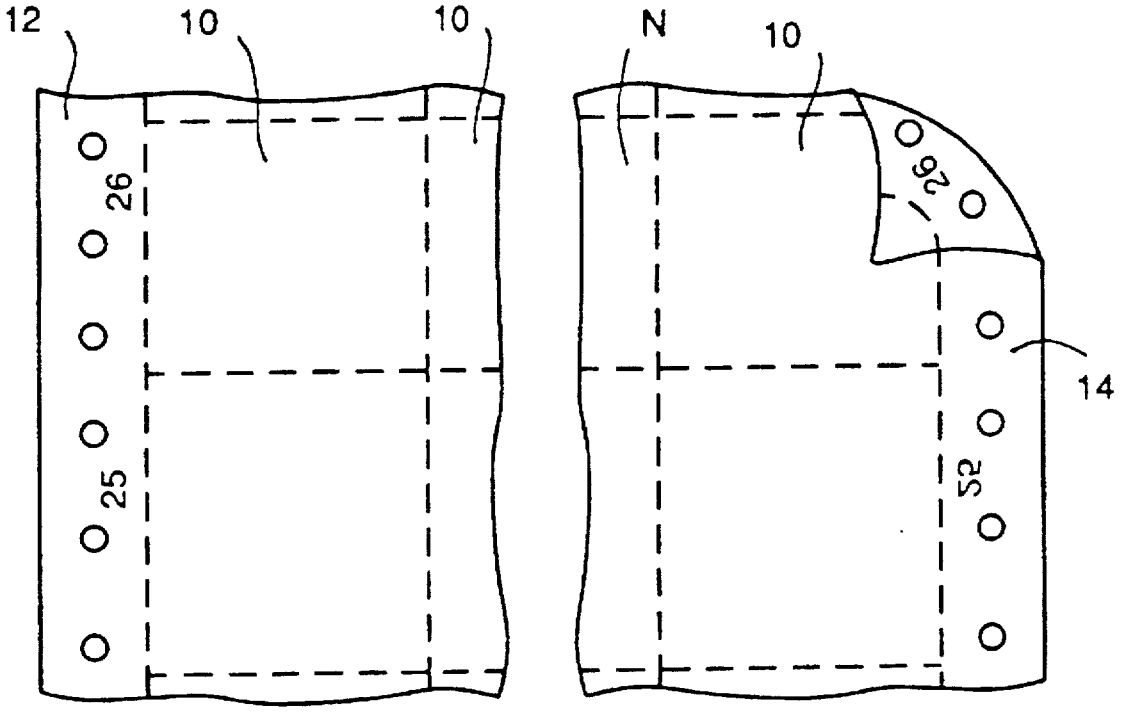
FIG. 2 illustrates a portion of a continuous web of blank labels having numbered carrier strips.

As shown in FIG. 2, web C can include a main portion formed of pre-perforated rectangular label blanks 10, arranged in horizontal rows of multiple labels each, for example eight, extending in a direction perpendicular to the direction of web movement. Carrier strips 12, 14 are situated on either side of the main portion of the web and are provided with sprocket holes adapted to be engaged by sprockets in the feed mechanism of each printer. Each row of labels may be numbered consecutively with numbers printed on the carrier strips, as is illustrated. These numbers will be used, as explained in detail below, to facilitate calculation of the spacing between the printers.

Figure 3:
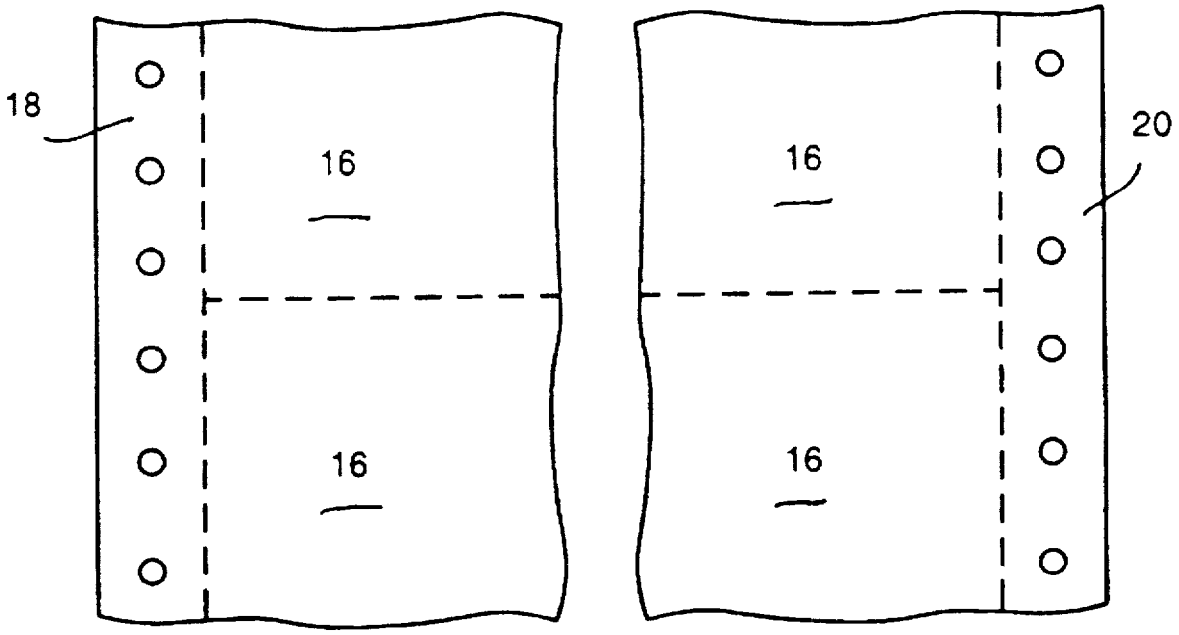
FIG. 3 illustrates a portion of a continuous web of blank sheets having unnumbered carrier strips.

FIG. 3 illustrates an alternate embodiment of the web. In this case, the main portion is made up of a series of single sheets or pages 16 extending in the direction of web movement. Again, carrier strips 18, 20 are provided. However, in this embodiment, the carrier strips are unnumbered.

In the following description, the term "section" will be used to refer to rows of labels 10, as illustrated in FIG. 2, or sheets 16, as illustrated in FIG. 3. The term "design" will be used to refer to the text, symbols, graphics and blank spaces which are to appear on the side of each section. "Different sections" refer to two or more sections each of which has a different design, on one or both sides, from that of the other sections.

Once the software program on diskette E is loaded into computer D, certain information must be entered into the computer before the print run begins. This information can be loaded into the computer using the keyboard or may be downloaded from another source. To begin with, the first and second designs to be printed by the first printer are entered. Next, the third and fourth designs to be printed by the second printer are entered.

For purposes of illustration, the method for printing two sets of sections with different designs, in sequence, will be described. It should be understood that many sets of sections with different designs can be printed in sequence, utilizing the same method, by repeating the appropriate steps.

The spacing between the printers must be calculated. This can be accomplished by simply counting number of sections between the printers and storing the number in computer memory as the first stored number.

However, if the sections are numbered, as illustrated in FIG. 2, one could simply observe the number of the section aligned with the first printer, observe the number aligned with the second printer and mentally subtract the two. Alternatively, the sub-routine illustrated in FIG. 5 may be employed. In that case, all that is required is that the numbers corresponding to the aligned sections be entered into the computer. The computer will call up the sub-routine, subtract one number from the other and store the difference as the first stored number.

When threading the web through the printers, it is recommended that sufficient slack in the web be present between the printers. In this way, tearing of the web will be avoided in the event that both printers do not finish printing respective section sides at the exact same time.

Each section in the first set of sections will be printed with the first design on one side (for example, the front) and the third design on the other side (for example, the back). The number of sections in this set is stored as the second stored number. Similarly, each section in the second set of sections will have printed thereon the second design on one side and the fourth design on the other side. The number of sections in the second set is stored as the third stored number.

For purposes of illustration we will assume that the number of sections between printers is smaller than the number of sections to be printed with each design. Otherwise provision must be made to advance the printers without printing a number of sections equal to the difference between the number of sections between printers and the number of sections to be printed.

When the sections comprise rows of labels, the computer is programmed to cause each print head to move in a direction perpendicular to web movement and repeat the design a number of times equal to the number of labels in each row, each time the printer is actuated to print a section.

The number of section sides printed by each counter with each design is tracked. This may be accomplished by two or more counters. Each counter is set to zero to begin.

Printer A is actuated to print one section side with the first design. Each printer is actuated to advance the web until the next section is aligned with the start position. If counters, are being used, the first and second counters are indexed. These steps are repeated as long as the number of section sides printed with the first design by the first printer is less than the first stored number, signifying that it is not yet time to actuate the second printer. If counters are used, this may be done by comparing the count on the first counter with the first number.

Once the number of section sides printed with the first design by the first printer is equal to the first stored number, the first counter is reset, the first printer is actuated to print one section side with the first design and the second printer is actuated to print one section side with the third design. Each printer is actuated to advance to the next section. If counters are used, the second counter is indexed. These steps are repeated as long as the number of section sides printed by the first printer with the first design is less than the second stored number. If counters are used, this may be determined by comparing the second counter with the second stored number.

Once the number of section sides printed by the first printer with the first design is equal to the second stored number, one side of each section in the first set has been printed with the first design. The first printer must now begin to print the second set of sections while the second printer continues to print the sections in the first set. Thus, the first printer is actuated to print one section side with the second design. The second printer is actuated to print one section side with the third design. Each printer advances to the next section. If counters are used, first and third counters are indexed. These steps are repeated as long as the number of section sides printed by the second printer with the third design is less than the number of sections in the second set. If counters are used, this can be determined by comparing the first counter with the first stored number.

When the number of section sides printed by the second printer with the third design is equal to the number of sections the second set, it is time to change the second printer over to begin to print the fourth design. The first counter is reset. The first printer is actuated to print one section side with the second design. The second printer is actuated to print one section with the fourth design. Each printer is advanced to the next section. If counters are used, the third counter is indexed. These steps are repeated as long as the number of section sides printed with the second design by the first printer is less than the third stored number, indicating that additional sections in the second set must be printed with the second design.

When the number of section sides printed with the second design by the first printer is equal to the number of sections in the second set, indicating that all sections in the second set have been printed with the second design, only the second printer need continue to print. This may be determined by comparing the third counter with the third stored number.

The second printer is then actuated to print one section side with the fourth design. Each printer advances to the next section. The first counter is indexed. These steps are repeated as long as the number of section sides printed with the fourth design by the second printer is less than the number of sections in the second set. This may be determined by comparing the count on the first counter with the first stored number. Once the number of section sides printed with the fourth design by the second printer is equal to the number of sections in the second set, the run is over. Both sides of each section in each set have been completed.

By repeating the appropriate steps, additional sets of sections with different designs can be printed sequentially. This requires storing the designs for both sides of the label in each set, as well as the number of labels in each set to be printed. These designs are then printed in the same manner, keeping track of the number of section sides printed by each printer with each design.

It should now be appreciated that the present invention relates to a computer implemented method for simultaneously controlling printers to print on both sides of labels in a continuous web and which permits sets of different labels to be printed sequentially. This is accomplished with no waste of stock and minimum set up time and run time.

While only a limited number of preferred embodiments of the present invention have been disclosed for purposes of illustration, it is obvious that many variations and modifications could be made thereto. It is intended to cover all of these variations and modifications which fall within the scope of the invention, as defined by the following claims:

I claim:

1. A computer implemented method for controlling the operation of first and second oppositely oriented, spaced tandem printers to print both sides of sections of a continuous web, the method comprising the steps of:

(a) Storing a first design for the first printer; Storing a second design for the second printer; Storing a first number representative of the number of sections between the section aligned with the first printer and the section aligned with the second printer; and Storing a second number equal to the number of sections to be printed;

(b) Actuating the first printer to print one section side and each printer to advance to the next section;

(c) Keeping track of the number of section sides printed by the first printer;

(d) Comparing the number of section sides printed by the first printer and first stored number, if less, return to step (b);

(e) Actuating each printer to print one section side and each printer to advance to the next section;

(f) Keeping track of the number of side sections printed by the second printer;

(g) Comparing the number of side sections printed by the first printer and the second stored number, if less, return to step (e);

(h) Actuating the second printer to print one section side and each printer to advance to the next section;

(i) Comparing the number of sides printed by the second printer with the second stored number, if less, return to step (h);

(j) End.

2. The method of claim 1 wherein the section comprises a label.

3. The method of claim 1 wherein the section comprises a row of labels and wherein the step of actuating a printer to print one section side comprises the step of actuating the printer to print one side of each label in a row of labels.

4. The method of claim 1 wherein the continuous web comprises a carrier strip adjacent the sections and further comprising the step of numbering the carrier strip sequentially to correspond to the sections.

5. The method of claim 1 wherein the step of storing a first number comprises the steps of determining the number corresponding to the section aligned with the first printer, determining the number corresponding to the number of the section aligned with the second printer, subtracting the numbers and storing the result.

6. The method of claim 1 contained on a diskette for use in a computer operably connected to the first and second printers.

7. The method of claim 1 provided in software for use in a computer operably connected to the first and second printers.

8. A computer implemented method for controlling the operation of first and second oppositely oriented, spaced tandem printers to print both sides of sections of a continuous web, the method comprising the steps of:

(a) Storing a first design for the first printer; Storing a second design for the second printer; Storing a first number representative of the number of sections between the section aligned with the first printer and the section aligned with the second printer;

and Storing a second number equal to the number of sections to be printed;

(b) Actuating the first printer to print one section side and each printer to advance to the next section and indexing first and second counters;

(c) Comparing the first counter and the first stored number, if less, return to step (b);

(d) Resetting the first counter;

(e) Actuating each printer to print one section side and each printer to advance to the next section and indexing the second counter;

(f) Comparing the second counter and the second stored number, if less, return to step (e);

(g) Actuating the second printer to print one section side and each printer to advance to the next section and indexing the first counter;

(h) Comparing the first counter with the first stored number, if less, return to step (g);

(i) End.

9. The method of claim 8 wherein the section comprises a label.

10. The method of claim 8 wherein the section comprises a row of labels and wherein the step of actuating a printer to print one section side comprises the step of actuating the printer to print one side of each label in a row of labels.

11. The method of claim 8 wherein the continuous web comprises a carrier strip adjacent the sections and further comprising the step of numbering the carrier strip sequentially to correspond to the sections.

12. The method of claim 11 wherein the step of storing a first number comprises the steps of determining the number corresponding to the section aligned with the first printer, determining the number corresponding to the number of the section aligned with the second printer, subtracting the numbers and storing the result.

13. The method of claim 8 contained on a diskette for use in a computer operably connected to the first and second printers.

14. The method of claim 8 provided in software for use in a computer operably connected to the first and second printers.

15. A computer implemented method for controlling the operation of first and second oppositely oriented, spaced tandem printers to print both sides of sets of sections with different designs, in sequence, on a continuous web, the method comprising the steps of:

(a) Storing first and second designs for the first printer; Storing third and fourth designs for the second printer; Storing a first number representative of the number of sections between the section aligned with the first printer and the section aligned with the second printer; Storing a second number equal to the number of sections in a first set to be printed with the first and third designs and storing a third number equal to the number of sections in a second set to be printed with the second and fourth designs;

(b) Actuating the first printer to print one section side with the first design and each printer to advance to the next section;

(c) Keeping track of the number of side sections printed by the each printer with each design;

(d) Comparing the number of side sections printed by the first printer with the first design and the first stored number, if less, return to step (b);

(e) Actuating the first printer to print one section with the first design, the second printer to print one section with the third design and each printer to advance to the next section;

(f) Comparing the number of section sides printed by the first printer with the first design and the second stored number, if less, return to step (e);

(g) Actuating the first printer to print one section side with the second design, the second printer to print one section side with the third design and each printer to advance to the next section;

(h) Comparing the number of section sides printed by the second printer with the third design and the second stored number, if less, return to step (g);

(i) Actuating the first printer to print one section side with the second design, the second printer to print one section side with the fourth design and each printer to advance to the next section;

(j) Comparing the number of side sections printed by the first printer with the second design with the third stored number, if less, return to step (i);

(k) Actuating the second printer to print one section side with the fourth design and each printer to advance to the next section;

(l) Comparing the number of side sections printed by the second printer with the fourth design and the third stored number, if less, return to step (k).

(m) End.

16. The method of claim 15 wherein each of the sections comprises a label.

17. The method of claim 15 wherein each of the sections comprises a row of labels and wherein the step of actuating a printer to print one section side comprises the step of actuating the printer to print one side of each label in a row of labels.

18. The method of claim 15 wherein the continuous web comprises a carrier strip adjacent the sections and further comparing the step of printing numbers on the carrier strip corresponding to the sections.

19. The method of claim 15 wherein the step of storing a first number comprises determining the number corresponding to the section aligned with the first printer, determining the number corresponding to the section aligned with the second printer, subtracting the numbers and storing the result.

20. The method of claim 15 contained on a diskette for use in a computer operably connected to the first and second printers.

21. The method of claim 15 provided in software for use in a computer operably connected to the first and second printers.

22. A computer implemented method for controlling the operation of first and second oppositely oriented, spaced tandem printers to print both sides of sets of sections with different designs, in sequence, on a continuous web, the method comprising the steps of:

(a) Storing first and second designs for the first printer; Storing third and fourth designs for the second printer; Storing a first number representative of the number of sections between the section aligned with the first printer and the section aligned with the second printer; Storing a second number equal to the number of sections in a first set to be printed with the first and third designs and storing a third number equal to the number of sections in a second set to be printed with the second and fourth designs;

(b) Actuating the first printer to print one section side with the first design, each printer to advance to the next section and indexing a first and a second counter;

(c) Comparing the first counter with the first stored number, if less, return to step (b);

(d) Resetting the first counter;

(e) Actuating the first printer to print one section with the first design, the second printer to print one section with the third design, each printer to advance to the next section and indexing the second counter;

(f) Comparing the second counter and the second stored number, if less, return to step (e);

(g) Actuating the first printer to print one section side with the second design, the second printer to print one section side with the third design, each printer to advance to the next section and indexing the first and third counters;

(h) Comparing the first counter and the first stored number, if less, return to step (g);

(i) Resetting the first counter;

(j) Actuating the first printer to print one section side with the second design, the second printer to print one section side with the fourth design, each printer to advance to the next section and indexing the third counter;

(k) Comparing the third counter with the third stored number, if less, return to step (m);

(l) Actuating the second printer to print one section side with the fourth design, each printer to advance to the next section and indexing the first counter;

(m) Comparing the first counter with the first stored number, if less, return to step (1);

(n) End.

23. The method of claim 22 wherein each of the sections comprises a label.

24. The method of claim 22 wherein each of the sections comprises a row of labels and wherein the step of actuating a printer to print one section side comprises the step of actuating the printer to print one side of each label in a row of labels.

25. The method of claim 22 wherein the continuous web comprises a carrier strip adjacent the sections and further comparing the step of printing numbers on the carrier strip corresponding to the sections.

26. The method of claim 22 wherein the step of storing a first number comprises determining the number corresponding to the section aligned with the first printer, determining the number corresponding to the section aligned with the second printer, subtracting the numbers and storing the result.

27. The method of claim 22 contained on a diskette for use in a computer operably connected to the first and second printers.

28. The method of claim 22 provided in software for use in a computer operably connected to the first and second printers.

* * * * *